US008492931B2

(12) United States Patent
Kim et al.

(10) Patent No.: US 8,492,931 B2
(45) Date of Patent: Jul. 23, 2013

(54) SELECTING STRUCTURE FOR DEVICE

(75) Inventors: Duk-Yong Kim, Gyeonggi-do (KR); Nam-Shin Park, Gyeonggi-do (KR); Byung-Chul Kim, Gyeonggi-do (KR); Sung-Ho Jang, Gyeonggi-do (KR)

(73) Assignee: KMW Inc., Hwaseong-si (KR)

( * ) Notice: Subject to any disclaimer, the term of this patent is extended or adjusted under 35 U.S.C. 154(b) by 469 days.

(21) Appl. No.: 12/958,834

(22) Filed: Dec. 2, 2010

(65) Prior Publication Data

US 2011/0127851 A1 Jun. 2, 2011

Related U.S. Application Data

(60) Provisional application No. 61/265,839, filed on Dec. 2, 2009.

(51) Int. Cl.
*H01H 31/10* (2006.01)

(52) U.S. Cl.
USPC ..... 307/115

(58) Field of Classification Search
USPC ..... 307/115, 112, 147, 149, 154
See application file for complete search history.

(56) References Cited

U.S. PATENT DOCUMENTS

| | | | |
|---|---|---|---|
| 3,969,690 | A | 7/1976 | Hansen et al. |
| 4,920,324 | A | 4/1990 | Whittaker et al. |
| 5,347,243 | A | 9/1994 | Kich et al. |

FOREIGN PATENT DOCUMENTS

| | | |
|---|---|---|
| JP | 11-220302 | 8/1999 |
| JP | 2001-197605 | 7/2001 |
| JP | 2002-148007 | 5/2002 |
| KR | 1020020070717 A | 9/2002 |

OTHER PUBLICATIONS

EPO; European Search Report; PCT/KR2010008601; Oct. 24, 2012; 6 pages.
KIPO; PCT/KR2010/008601; Jul. 27, 2011; 3 pages.

*Primary Examiner* — Jared Fureman
*Assistant Examiner* — Duc M Pham

(57) ABSTRACT

Disclosed is a device selection structure for selecting one or more devices, comprising: a plurality of devices each having an input port and an output port; and a device module including a movement plate installed movably in conjunction with the plurality of devices, an input connector, and an output connector, wherein the input and output ports of the plurality of devices and the input and output connectors of the device module are installed so that during movement of the movement plate, the input and output ports of the plurality of devices are sequentially connected, at predetermined positions, to the input and output connectors of the device module.

18 Claims, 3 Drawing Sheets

SELECTING STRUCTURE FOR DEVICE

PRIORITY

The present application claims priority under 35 U.S.C. §119(e) to Provisional Application No. 61/265,839, entitled "SELECTING STRUCTURE FOR DEVICE," which was filed in the United States Patent and Trademark Office on Dec. 2, 2009, the entire disclosure of which is incorporated herein by reference.

BACKGROUND OF THE INVENTION

1. Field of the Invention

The present invention relates to a device selection structure for selecting one or more devices from among a plurality of devices and operating the selected devices.

2. Description of the Related Art

Each of electrical and electronic devices used in a wide range of technological fields may be configured so that it has a plurality of devices to perform specific functions and one or more of the devices are selected for operation by, for example, a switch. Such devices may differ in operation range, operation criterion, and operation scheme. According to the installation environment or operation condition of the devices, the best one may be selected from among the devices, manually or automatically.

The desired device may be selected by establishing a signal processing path to the desired device using a switch.

SUMMARY OF THE INVENTION

An aspect of exemplary embodiments of the present invention is to provide a device selection structure for reducing the loss of a processed signal.

Another aspect of exemplary embodiments of the present invention is to provide a device selection structure that can be implemented with simplicity and low cost.

In accordance with an aspect of exemplary embodiments of the present invention, there is provided a device selection structure for selecting one or more devices, in which a plurality of devices each have an input port and an output port, and a device module includes a movement plate installed movably in conjunction with the plurality of devices, an input connector, and an output connector. The input and output ports of the plurality of devices and the input and output connectors of the device module are installed so that during movement of the movement plate, the input and output ports of the plurality of devices are sequentially connected, at predetermined positions, to the input and output connectors of the device module.

DETAILED DESCRIPTION OF THE PREFERRED EMBODIMENT

Now, a preferred embodiment of the present invention will be described with reference to the attached drawings. While specific details such as components are described in the following description, they are given to help comprehensive understanding of the present invention. Therefore, it is clearly to be understood to those skilled in the art that changes or modifications can be made to the present invention within the scope and spirit of the present invention.

The following description is made with the appreciation that a device selection structure of the present invention is applied to a wireless communication Base Station (BS) system or relay system, by way of example. The wireless communication BS system or relay system may employ at least one filter for filtering a transmission signal or a received signal. In the case where a service band needs to be changed depending on the business condition of a service provider of the system, the filtering band of a radio signal should be changed. Replacing the existing filter to change the filtering band is inefficient in terms of time or cost.

Accordingly, it may be contemplated that a plurality of filters having different filtering characteristics are installed in advance and one of the filters is selected using a switch.

Figure 1:
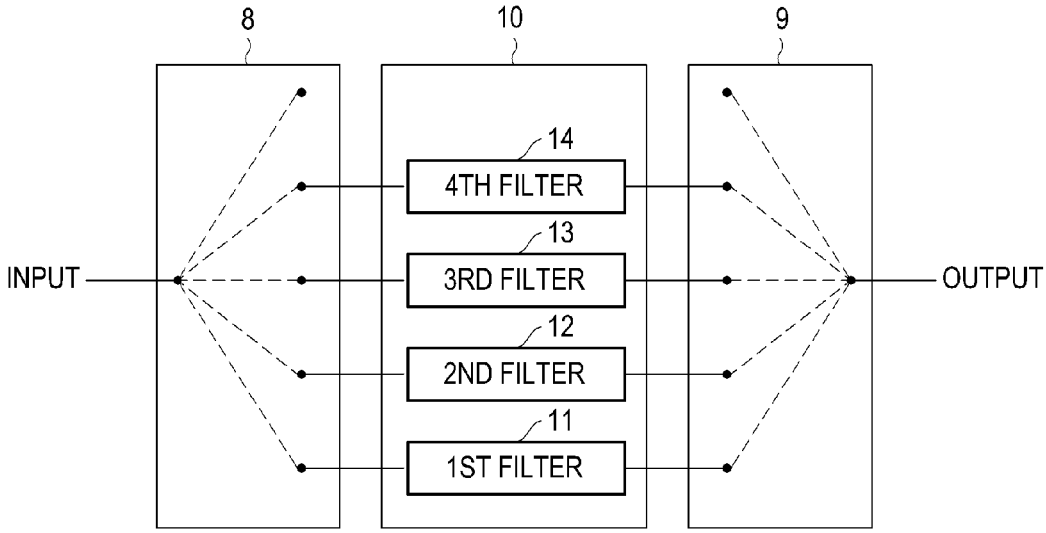
FIG. 1 is a block diagram of a virtual structure that can be replaced with a device selection structure of the present invention.

FIG. 1 is a block diagram of a virtual structure that can be replaced with a device selection structure of the present invention. Referring to FIG. 1, the structure includes an input-end switch 8, an output-end switch 9, and a filter module 10 having a plurality of filters 11, 12, 13 and 14. The filters 11, 12, 13 and 14 of the filter module 10 are designed so as to have different pass bands. Each of the input-end switch 8 and the output-end switch 9 may have a 1:N (1:5 in FIG. 1) switching structure in which the switch connects an input or output path to one of the filters 11 to 14 or to none of the filters 11 to 14.

Since an input signal passes through the input-end switch 8 and is provided to the filter module 10 and then to the output-end switch 9 in the above configuration, the signal is lost significantly during passing through the input-end switch 8 and the output-end switch 9. In this context, the present invention provides a structure for selecting a desired device (e.g. a filter) without using the input-end switch 8 and the output-end switch 9.

Figure 2:
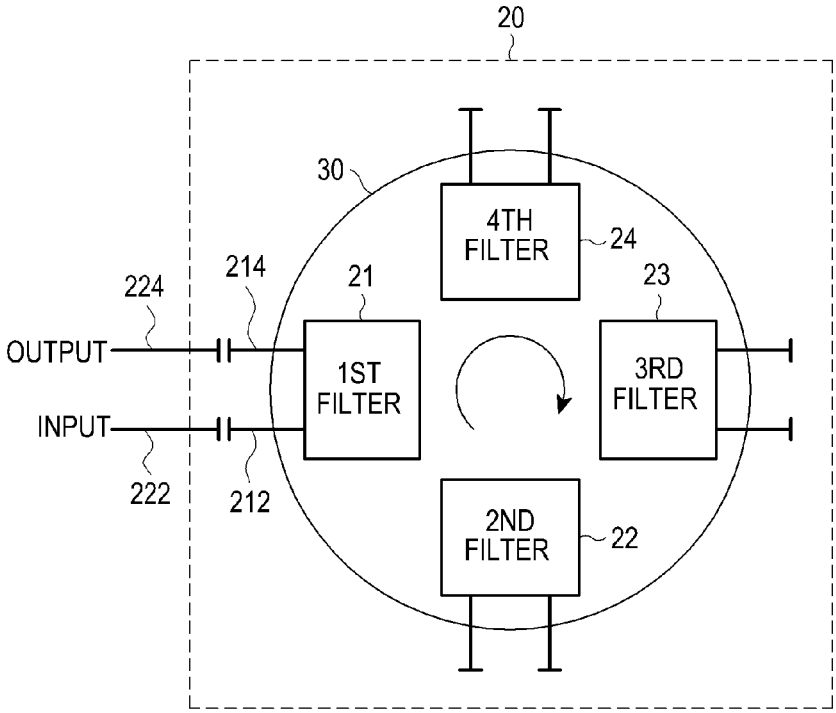
FIG. 2 is a block diagram of a device selection structure according to an embodiment of the present invention.
Figure 3:
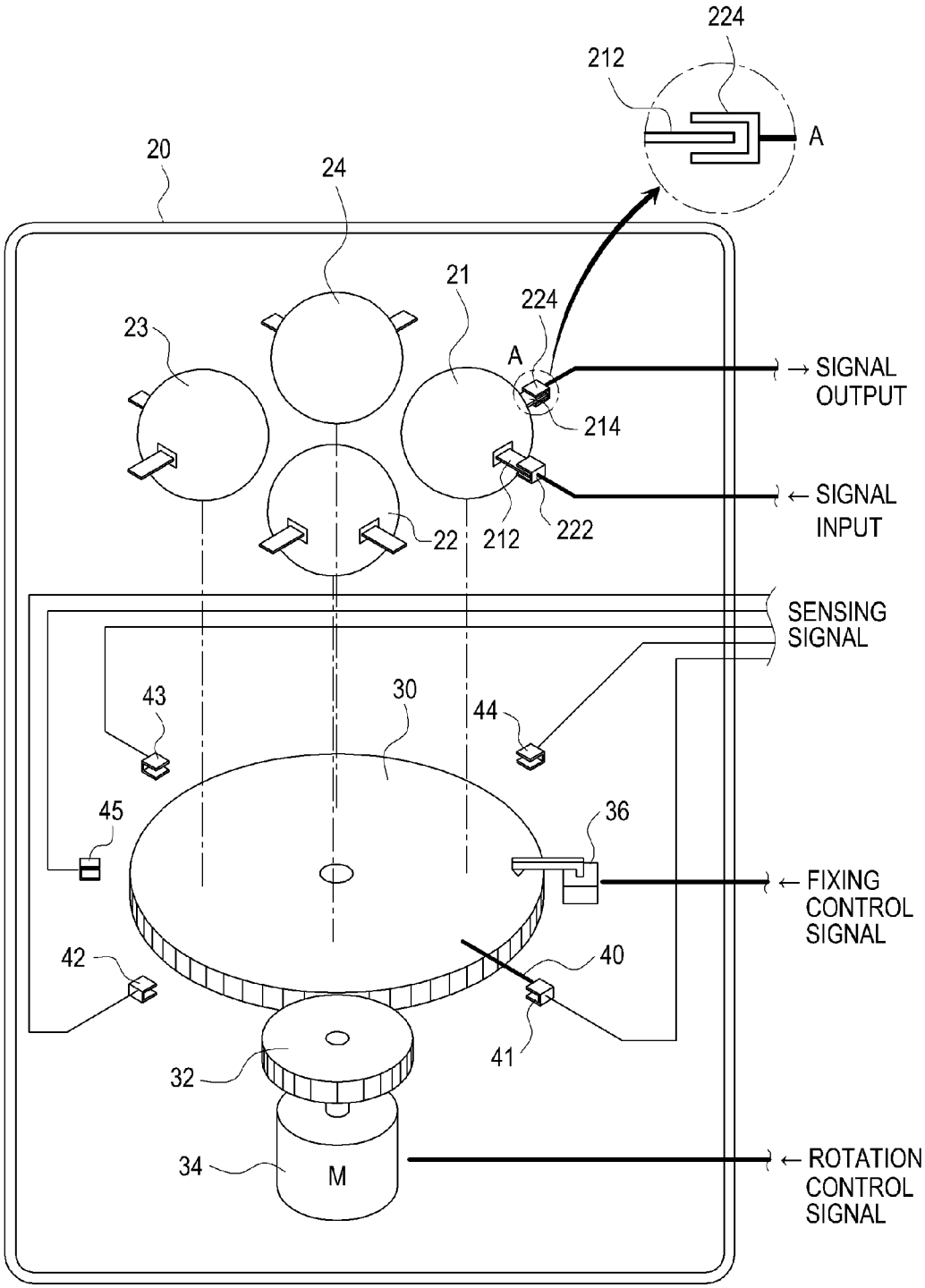
FIG. 3 is a schematic perspective view of the device selection structure according to the embodiment of the present invention.

FIG. 2 is a block diagram of a device selection structure according to an embodiment of the present invention and FIG. 3 is a schematic perspective view of the device selection structure according to the embodiment of the present invention. Referring to FIGS. 2 and 3, the device selection structure includes only a filter module 20 with a plurality of filters 21 to 24 without a switching structure. The plurality of filters 21 to 24 are installed symmetrically at up, down, left and right positions on a rotation plate 30 which is rotatably installed. Hence, the filters 21 to 24 are rotated along with rotation of the rotation plate 30.

It is important to configure the filters 21 to 24 such that their input and output ports move in the same trajectory during rotation of the rotation plate 30. Specifically, the input and output ports of the filters 21 to 24 are sequentially connected to an input connector 222 and an output connector 224 of the filter module 20, at preset connection positions (i.e. positions at which the input and output connectors of the filter module are installed) during rotation of the rotation plate 30. That is, the filters 21 to 24 are designed so that when the filters 21 to 24 move to the positions where they are connected to the input and output connectors 222 and 224 of the filter module 20, the input and output ports of the filters 21 to 24 perfectly correspond to the filter modules 222 and 224. In an example of FIGS. 2 and 3, input and output ports 212 and 214 of the first filter 21 are connected respectively to the input and output connectors 222 and 224 of the filter module 20.

The input and output ports of the filters 21 to 24 may be connected to the input and output connectors 222 in a non-contact manner in which a signal is transmitted through mutual capacitance coupling, as indicated by a one-dotted circle A in FIG. 3.

The rotation plate 30 with the filters 21 to 24 mounted on top is provided with a gear structure. The gear structure rotates in conjunction with a force transfer gear structure 32 connected to a driving motor 34 driven according to an external rotation control signal.

To sense the rotation state of the rotation plate 30, that is, the positions of the filters 21 to 24 on the rotation plate 30, a plurality of position sensors 41 to 45 may be further provided. Each of the position sensors 41 to 45 senses the position of a position indication pin 40 installed on the rotation plate 30 and outputs the resulting sensing signal. The position sensors 41 to 45 and position indication pins 40 are arranged so as to sense that each of the filters 21 to 24 is positioned in correspondence with the input and output connectors 222 and 224 of the filter module 20 along with rotation of the rotation plate 30.

In addition, a mechanical fixing unit 36 may be provided to press a fixing jig onto the rotation plate 30 (or a groove or hole formed into the rotation plate 30). The mechanical fixing unit 36 functions to fix the rotation plate 30 not to rotate or move against an external impact, when the rotation plate 30 is at an appropriate position.

The above-described device selection structure according to the embodiment of the present invention connects the input and output ports of the filters to the input and output connectors of the filter module without using a switching structure. Therefore, the device selection structure can reduce signal loss and can be implemented with simplicity and low cost.

The filters may be spherical or quasi-spherical as disclosed in Korea Patent Application No. 2009-63222 entitled "Multi-Mode Resonator" and filed on Jul. 10, 2009 (inventors: Duk Yong KIM and Nam Sin PARK), Korea Patent Application No. 2010-55398 entitled "Multi-Mode Resonant Filter" (Jul. 9, 2010), U.S. Provisional Application No. 61/224,523 entitled "Multi-Mode Resonator" (Jul. 10, 2009) and U.S. application Ser. No. 12/833,195 entitled "Multi-Mode Resonant Filter" (Jul. 9, 2010). A filter disclosed in the above patent applications includes a housing with a spherical cavity, a dielectric resonator accommodated in the cavity of the housing, and at least one transmission line that connects a point on one of first, second and third axes independently perpendicular to one another with respect to the center of the dielectric resonator to a point on another of the first, second and third axes. Input and output connectors are installed at one end of the transmission line.

Figure 4:
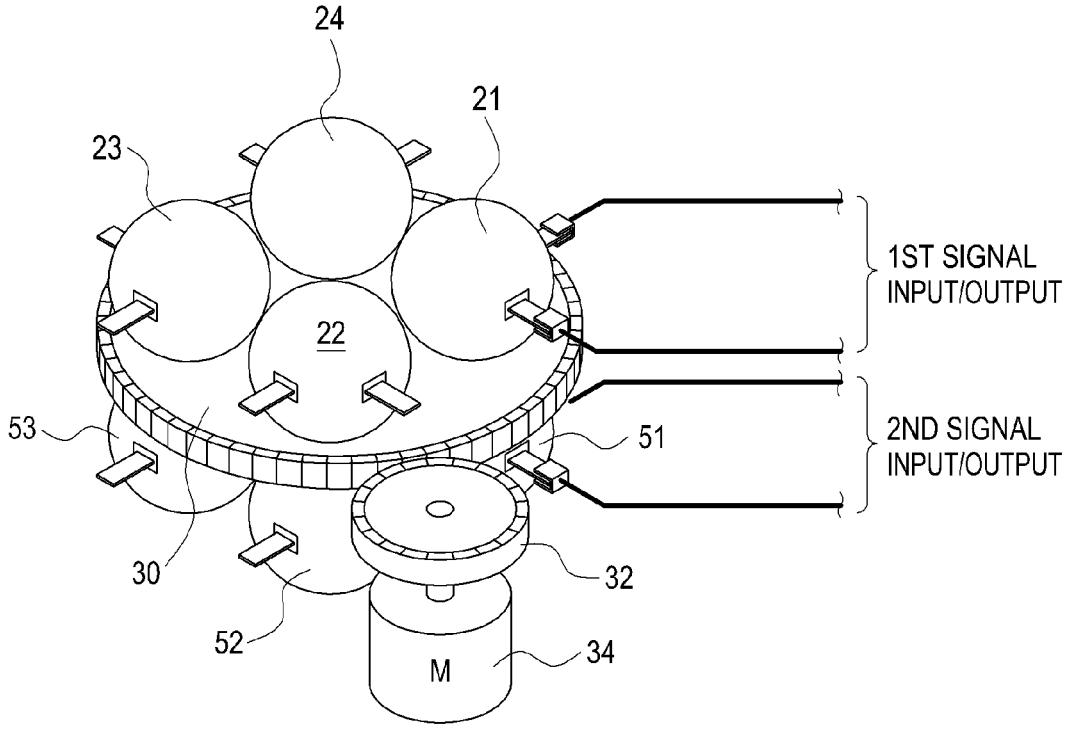
FIG. 4 is a schematic perspective view of an important part of a device selection structure according to another embodiment of the present invention.

FIG. 4 is a schematic perspective view of an important part of a device selection structure according to another embodiment of the present invention. Referring to FIG. 4, the device selection structure is similar to the first embodiment illustrated in FIGS. 2 and 3, except that a plurality of filters 51, 52 and 53 are installed on the bottom surface of the rotation plate 30 in addition to the filters 21 to 24 installed on the top surface of the rotation plate 30 and the filter module further includes input and output connectors that are connected to one of the filters 51, 52 and 53.

In this configuration, a first signal can be processed using a first group of the filters 21 to 24 on the top surface of the rotation plate 30 and at the same time, a second signal can be processed using a second group of the filters 51, 52 and 53 on the bottom surface of the rotation plate 30.

The device selection structure according to the embodiment of the present invention may be configured as described above. While the embodiments of the present invention have been described, many modifications can be made within the scope and spirit of the present invention. For example, while it has been described that four filters are used in the first embodiment, the number of filters may be 2 or larger. In addition, while it has been described with reference to FIG. 4 that filters are provided in two layers, they may be stacked in more layers.

The input and output ports of filters and the input and output connectors of a filter module are installed beside the filters in the drawings. On the other hand, they may be installed at various positions such as up and down. The input and output ports of the filters may be connected to the input and output connectors of the filter module in a contact manner.

While it has been described that the filters are installed rotatably on a circular rotation plate, they may be installed linearly to make a linear movement.

As described above, because the device selection structure of the present invention does not employ a conventional switching structure, it can reduce signal loss as experienced by the conventional switching structure. The device selection structure can also be implemented with simplicity and low cost.

While the present invention has been described in the context of a device being a filter, it is applicable to many other devices. Thus, it will be understood by those skilled in the art that various changes in form and details may be made therein without departing from the spirit and scope of the present invention as defined by the appended claims and their equivalents.

What is claimed is:

1. A device selection structure for selecting one or more devices, comprising:

a plurality of devices each having an input port and an output port; and a device module including a movement plate installed movably in conjunction with the plurality of devices, an input connector, and an output connector, wherein the input and output ports of the plurality of devices and the input and output connectors of the device module are installed so that during movement of the movement plate, the input and output ports of the plurality of devices are sequentially connected, at predetermined positions, to the input and output connectors of the device module.

2. The device selection structure of claim 1, wherein the movement of the movement plate is rotation and the movement plate is a rotatably installed rotation plate.

3. The device selection structure of claim 1, wherein the device module further includes at least one position sensor for sensing a movement state of the movement plate and outputting a sensing signal according to the sensing.

4. The device selection structure of claim 1, wherein the device module further includes a mechanical fixing unit for fixing the movement plate according to an external control signal.

5. The device selection structure of claim 1, wherein the plurality of devices are stacked in two or more layers and the device module includes the input and output connectors for each layer of devices, and wherein the input and output ports of the plurality of devices and the input and output connectors of the device module are installed so that during movement of the movement plate, the input and output ports of the plurality of devices are sequentially connected, at predetermined positions, to the input and output connectors of the device module, in each layer of the device module.

6. The device selection structure of claim 1, wherein the devices are filters.

7. The device selection structure of claim 6, wherein the filters are spherical or quasi-spherical.

8. The device selection structure of claim 6, wherein the input and output ports of the plurality of devices are connected to the input and output connectors of the device module in a non-contact connection fashion in which a signal is transmitted through capacitance coupling.

9. The device selection structure of claim 6, wherein the movement of the movement plate is rotation and the movement plate is a rotatably installed rotation plate.

10. The device selection structure of claim 6, wherein the device module further includes at least one position sensor for sensing a movement state of the movement plate and outputting a sensing signal according to the sensing.

11. The device selection structure of claim 6, wherein the device module further includes a mechanical fixing unit for fixing the movement plate according to an external control signal.

12. The device selection structure of claim 6, wherein the plurality of devices are stacked in two or more layers and the device module includes the input and output connectors for each layer of devices, and wherein the input and output ports of the plurality of devices and the input and output connectors of the device module are installed so that during movement of the movement plate, the input and output ports of the plurality of devices are sequentially connected, at predetermined positions, to the input and output connectors of the device module, in each layer of the device module.

13. The device selection structure of claim 1, wherein the input and output ports of the plurality of devices are connected to the input and output connectors of the device module in a non-contact connection fashion in which a signal is transmitted through capacitance coupling.

14. The device selection structure of claim 13, wherein the devices are spherical or quasi-spherical filters.

15. The device selection structure of claim 13, wherein the movement of the movement plate is rotation and the movement plate is a rotatably installed rotation plate.

16. The device selection structure of claim 13, wherein the device module further includes at least one position sensor for sensing a movement state of the movement plate and outputting a sensing signal according to the sensing.

17. The device selection structure of claim 13, wherein the device module further includes a mechanical fixing unit for fixing the movement plate according to an external control signal.

18. The device selection structure of claim 13, wherein the plurality of devices are stacked in two or more layers and the device module includes the input and output connectors for each layer of devices, and wherein the input and output ports of the plurality of devices and the input and output connectors of the device module are installed so that during movement of the movement plate, the input and output ports of the plurality of devices are sequentially connected, at predetermined positions, to the input and output connectors of the device module, in each layer of the device module.

* * * * *